175-48

1/12/82 XR 4,310,050 SR

United States Patent [19]

Bourgoyne, Jr.

[11] 4,310,050

[45] Jan. 12, 1982

[54] WELL DRILLING APPARATUS

[75] Inventor: Adam T. Bourgoyne, Jr., Baton Rouge, La.

[73] Assignee: Otis Engineering Corporation, Dallas, Tex.

[21] Appl. No.: 212,573

[22] Filed: Dec. 3, 1980

Related U.S. Application Data

[62] Division of Ser. No. 144,690, Apr. 28, 1980.

[51] Int. Cl.[3] ..... E21B 21/10

[52] U.S. Cl. ..... 166/318; 137/501; 166/322; 175/48; 175/317

[58] Field of Search ..... 166/318, 319, 320, 321, 166/322; 137/501

[56] References Cited

U.S. PATENT DOCUMENTS

| | | | |
|---|---|---|---|
| 3,005,507 | 10/1961 | Clark et al. | 166/319 X |
| 3,007,523 | 11/1961 | Vincent | 166/318 X |
| 3,282,323 | 11/1966 | Katz et al. | 137/501 X |
| 3,357,448 | 12/1967 | Martin | 137/501 |
| 3,482,405 | 12/1969 | Sansevero, Jr. | 137/501 X |
| 3,542,130 | 11/1970 | Stout | 166/318 |
| 3,799,278 | 3/1974 | Oliver | 175/317 X |
| 3,908,769 | 9/1975 | Schuyf et al. | 175/48 |

*Primary Examiner*—Stephen J. Novosad
*Attorney, Agent, or Firm*—Vinson & Elkins

[57] ABSTRACT

A method of and apparatus for removing fluids entering into a well bore from a well formation while the well is being drilled, such as gas, in which the gas bubble is chopped into small bubbles by mixing the gas with drilling mud and pumping the mixed gas and drilling mud upwardly through the drill string-bore hole annulus and removing it from the well.

6 Claims, 17 Drawing Figures

WELL DRILLING APPARATUS

This is a division of my copending application Ser. No. 144,690, filed Apr. 28, 1980, for WELL DRILLING METHOD.

This invention relates to the drilling of wells and more particularly to the removal of undesired formation fluid intrusions from the well bore during the drilling operation.

Wells are conventionally drilled for the production of oil and gas utilizing a drill string having a bit on bottom which may be rotated by rotating the drill string or by operation of a driving motor located near the bottom of the string. Weight is normally applied to the bit by a section of heavy drill collars which make up a part of the drill string immediately above the bit. During drilling operations drilling mud is circulated down the drill string and up the bore hole. The drilling mud performs many functions, one of which is to exert a pressure on the well bore which is greater than the pore pressure of all exposed formations throughout the open bore penetrated by the bit.

It sometimes happens that a formation is penetrated which exerts a greater pore pressure than the pressure exerted by the hydrostatic head of drilling mud. When this occurs the well "kicks" and fluids enter the bore hole from the formation. This most commonly occurs at the bottom of the well bore where a new formation is penetrated but it can possibly occur at a level in the well bore above bottom if the well bore pressure exerted by the drilling mud at that point is allowed to fall below the formation pore pressure subsequent to drilling the formation.

Surface conditions are carefully monitored at all times during drilling to detect a "kick", especially the volume of mud in the mud tanks. When a kick occurs the volume of drilling mud in the mud tanks will increase, indicating the existence of a kick.

When a kick occurs the mud pumps are stopped and the blowout preventers at the wellhead are used to close the annular space outside the drill pipe. The well is then permitted to stabilize. The stabilized conditions will normally indicate whether the kick was caused by liquid or gaseous well fluids. The greatest problems are encountered where all or a portion of the kick is gas.

In a typical kick caused by a gas bearing formation the well will stabilize with the pressure at the hole bottom being equal to the pore pressure of the formation. Typically, the drill string will be filled with drilling mud which has not been significantly displaced by the gas kick and the hydrostatic head of this column of drilling mud plus the shut-in drill pipe pressure at its upper end equals the pore pressure of the formation. A knowledge of the formation pressure allows the determination of the increase in drilling mud density needed to overcome the formation pressure and the determination of the required back pressure to be maintained on the drill pipe-casing annulus while pumping the kick fluids from the well bore and the more dense drilling mud into the well. Back pressure is maintained on the drill pipe-casing annulus by circulating the well through an adjustable choke.

As a gas kick is pumped up the well bore, the hydrostatic pressure exerted by the drilling mud above the kick decreases, causing the gas to expand in volume. In order to maintain a pressure down hole which will prevent more formation fluids from entering the well bore, the back pressure on the casing must be increased to compensate for this increasing volume of gas which exerts very little hydrostatic pressure. This results in well pressure in the areas below the surface casing being abnormally high and it sometimes occurs that a weak formation will be fractured resulting in an underground blowout. Procedures required to stop an underground blowout often renders the well unusable.

Many different procedures have been employed to try and minimize the effect of a well kick but prior to this time a satisfactory solution to the problem has not been found. For instance, it has been proposed to reverse circulate, to set packers in the hole and the like. All of the solutions which have previously been proposed have been beset with problems and until this time no satisfactory method of handling a well kick and particularly a large gas kick has been available. For instance, in reverse circulation the passageways through the drill bit frequently become clogged and prevent reverse circulation. Also, when a significant length of encased bore hole is present, formation fracture is almost assured when exposing the annulus to the full pump pressure. The setting of packers in the hole presents a problem of having a packer in place on the drill string and successfully setting this packer in an open hole. It is difficult and sometimes impossible to set a packer in an open hole.

In accordance with this invention, kick fluids are removed from the well bore gradually by mixing them with drilling mud so that they are chopped up into small volumes. For instance, if a kick is considered to be pure gas, the bubble of gas in the well bore will be chopped up into smaller bubbles and mixed with drilling mud. This will result in the overall gas-mud mixture exerting a substantial hydrostatic pressure and reduce the peak pressure on the weaker formations in the upper portion of the open bore. Instead of the entire bubble of gas being removed from the well at one time, the bubble is removed a little at a time. While the top portion of the bubble of gas is being removed, the bottom of the bubble will be at a substantial depth in the well resulting in lower pressures on formations at intermediate levels.

By chopping the gas kick into small bubbles, a further substantial advantage is obtained in that the time for removing the gas kick from the well is greatly increased, thus solving the problem of having to very quickly adjust the back pressure choke to meet rapidly changing conditions, such as where substantially pure drilling mud gives way to substantially pure gas in a section of the well system having a reduced cross sectional area. This is especially important on floating drilling vessels where a relatively small diameter choke line connects a subsea wellhead to the drilling vessel.

It is an object of this invention to be able to remove formation fluids which have entered the well bore during the process of drilling the well in a manner in which the maximum pressures exerted on the well at points intermediate its depth are minimized.

Another object of this invention is to be able to remove formation fluids which have entered the well bore during the process of drilling the well in which the pressures exerted on surface equipment are minimized.

Another object of this invention is to be able to remove formation fluids which have entered the well bore during the process of drilling the well in which as the well fluids are removed from the well bore the rate of pressure change with time is minimized.

Another object of this invention is to be able to remove formation fluids which have entered the well bore during the process of drilling the well in which a column of formation fluids rising in the bore hole is chopped into small increments by drilling mud.

Another object of this invention is to provide a landing nipple-diverter and a flow control apparatus which may be dropped into the landing nipple-diverter to divert a portion of fluids pumped into the tubing into the casing-tubing annulus in response to pressure applied to the tubing.

Another object of this invention is to provide a landing nipple-diverter and a flow control apparatus as in the preceding object in which a plug may be dropped and sealingly engage the flow control apparatus to permit pressure to release the flow control apparatus from the landing nipple-diverter to return the system to normal drilling conditions.

Other objects, features and advantages of the invention will be apparent from the drawings, the specification and the claims.

In the drawings wherein illustrative embodiments of this invention are shown and wherein like reference numerals indicate like parts:

Figures 1, 2A, 2B, 3A, 3B, 3C, 3D:
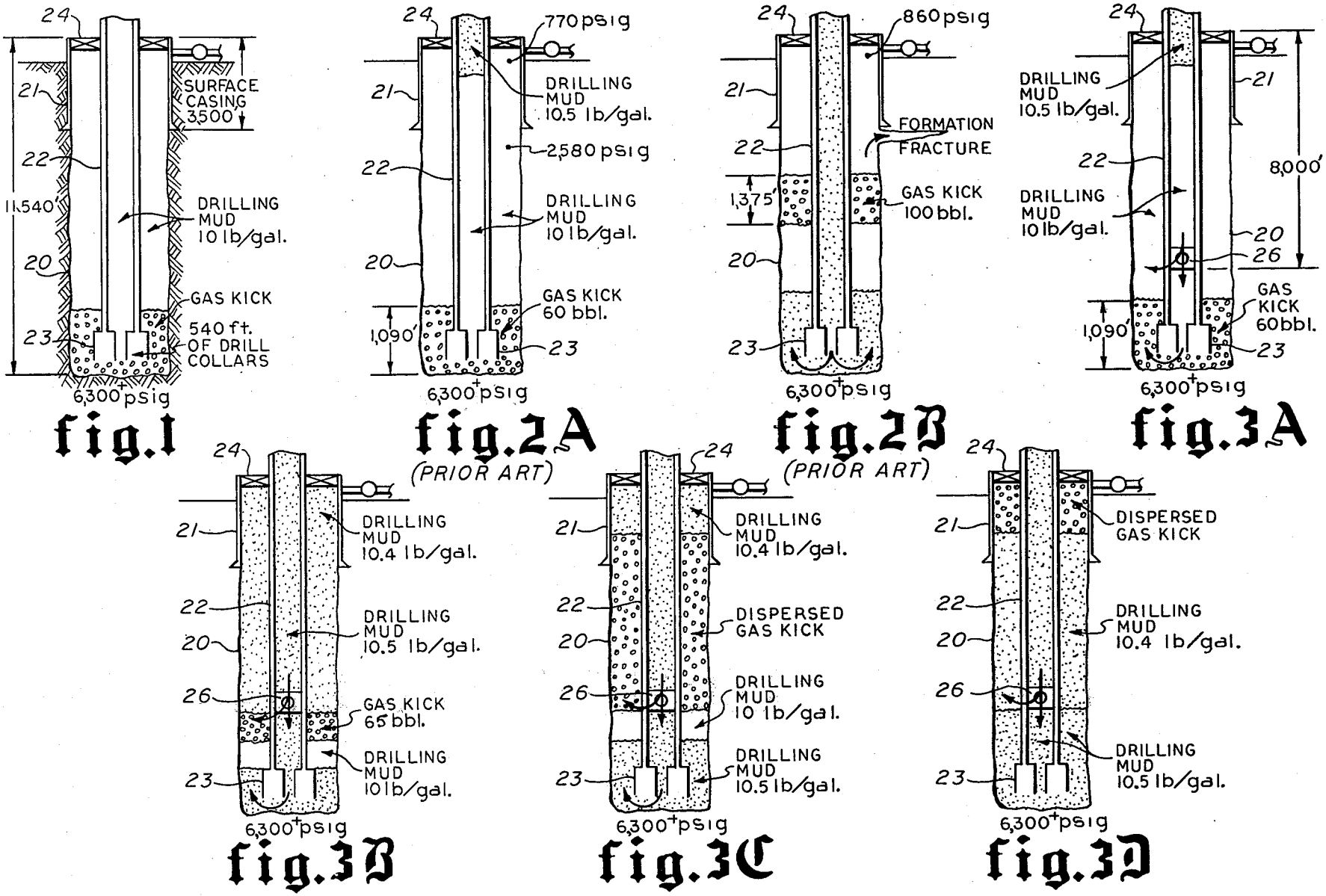
fig.2A (PRIOR ART)
fig.2B (PRIOR ART)
FIG. 1 is a schematic illustration of a well being drilled in which a gas kick has been experienced and the blowout preventers have been closed and the mud pumps stopped to stabilize pressure in the well bore.
FIGS. 2A and 2B are schematic illustrations of the prior art showing in FIG. 2A a gas kick to have occurred in the well and the wait and weight method being employed to circulate the well fluids from the hole and in FIG. 2B showing the gas bubble being pumped up the well bore and resulting in an underground blowout.
FIGS. 3A, 3B, 3C and 3D are schematic illustrations of a gas kick being removed from a well utilizing the bubble chopper concept of this invention and illustrating the removal of the same gas bubble while maintaining the pressure conditions within the well at a sufficiently low level to prevent a downhole blowout.

In practicing this invention any desired well control procedure may be modified in accordance with this invention to break the kick fluids into small volumes or bubbles by injecting drilling mud into the well fluids as they move up the bore hole.

For instance, the "driller's method" may be used. The driller's method is to pump the kick fluids from the well with normal circulation using the original mud in the system when the kick occurred. The new mud density required to overcome the formation pressure is then circulated into the well on a second well circulation. In using this method the drilling mud would be injected into the kick fluids rising in the bore hole in accordance with this invention.

Another well known method is the wait and weight method or the "engineer's method". This method is normally preferred where modern mud mixing equipment is available. With this method mud having sufficient density to overcome the formation pressure is mixed and injected into the well to displace the original mud and the formation fluids resulting from the kick. In this method the drilling mud will also be injected into the kick fluids as they rise in the well bore. It will be appreciated that any other desired method of removing the kick fluids from the bore hole can be utilized with this invention by injecting drilling fluids into the rising formation fluids.

In practicing the method of this invention, provision will be made to inject drilling mud into the rising formation fluids resulting from a kick. There will be disclosed in detail hereinafter methods of injecting drilling mud through a side port in the drill string while continuing circulation through the bottom of the drill string or while closing off circulation through the bottom of the drill string. There will also be disclosed the running of an additional conduit into the well bore to inject drilling mud. There will further be disclosed injecting drilling mud into the rising formation fluids at the wellhead where the wellhead is at an elevation below the drilling platform, such as in offshore drilling from a floating vessel. In all cases the rising kick fluids will be subjected to the injection or mixing of drilling mud with the rising kick fluids which will greatly increase the hydrostatic pressure exerted by the column of mixed rising kick fluids and drilling mud.

Wells are conventionally drilled with an open bore below a surface casing which may be set in the well and extend from the surface down several thousand feet, such as the 3,500' employed in the examples shown in this application. Additional casing may be set below the surface casing during drilling operations but in most instances there will be a substantial well bore depth which is uncased exposing the formations penetrated by the drill to drilling mud.

During drilling the well will conventionally have at the surface blowout preventers to guard against a well kick and control the well in the event a kick occurs. During normal drilling operations the blowout preventers will be in an open position. If during drilling it becomes apparent that the well has kicked, the blowout preventers are normally closed about the drill string to close the well bore-drill pipe annulus, hereinafter referred to as well bore annulus. The presence of a kick may be readily determined by any desired method, such as monitoring the depth of drilling mud in the mud tanks. By carefully monitoring the amount of mud in the tanks the occurrence of a well kick can be readily noted from an increase in the mud level in the pits.

Upon being determined that a well kick has occurred, the mud pumps are stopped and the blowout preventers are closed about the drill pipe to close the well bore annulus. The construction of the mud pump is normally of the poppet valve type and reverse flow cannot occur through the mud pump. Thus, shutting down the mud pump effectively closes in the top of the drill string. In addition suitable valves may be provided to close in the top of the drill pipe if desired.

With the drill pipe and the well bore both closed, the well is permitted to stabilize. The condition of the well after stabilization is utilized to plan remedial measures. For instance, the drill pipe will be filled with drilling mud and the density of this mud is known. By reading the shut-in drill pipe pressure at the surface and calculating the hydrostatic pressure exerted at the bottom of the hole, the pore pressure of the formation at the bottom of the hole can be determined and the density of mud to offset this pore pressure calculated.

From the information obtained during stabilization of the well, the back pressure to be exerted on the well bore as the kick is circulated to the surface can be determined. This back pressure, together with the pressure exerted by the hydrostatic head of fluid in the well bore, must, of course, be greater than the pore pressure of the formation to prevent further formation fluids entering the bore hole. Normally, it is considered that a kick occurs at the bottom of the hole in a newly penetrated formation. It is possible, however, for a kick to occur up the hole for various reasons, such as the swabbing effect of raising the drill string. In either event the kicking formation may, for theoretical considerations, be considered to be on bottom as the pressure conditions in the well bore and drill string when the well is stabilized will indicate the needed increase in drilling mud weight to prevent any additional formation fluids from entering the bore hole.

To remove the kick fluids from the bore hole, the mud pump is restarted and drilling mud pumped downwardly in the drill pipe. At this time drilling mud is also introduced into the rising column of drilling mud in the bore hole at a selected point or points spaced upwardly from the bottom of the well bore. It has been observed that a gas kick tends to be a substantially constant elongated bubble extending upwardly in the bore hole annulus. If this bubble of well fluids can be mixed with mud a reduced wellhead casing pressure will result. *Journal of Petroleum Technology,* May, 1975; *Petroleum Engineering,* September, 1979. In accordance with this invention as the kick fluids rise in the bore hole, they are intermixed with drilling mud being introduced at a point or points above the bottom of the well bore. This intermixing of fluids tends to break the formation fluids into small volumes interspersed with drilling mud. Thus, by injecting drilling mud into this rising gas zone, the gas bubble is chopped into a number of small bubbles and the vertical distance between the beginning and end of the bubble greatly increased. It results that the hydrostatic pressure exerted on the gas in the bottom portion of the kick is increased over that of a non-dispersed gas kick. This reduces the maximum gas volume in the well, thus reducing the danger of down hole blowouts, excessive pressures exerted on surface equipment, and the rate at which choke pressure must change with time.

The drilling mud may be introduced into the well bore at any desired point above the bottom of the well bore. It should be up hole a sufficient distance to be certain that the drilling mud will be introduced into the kick fluids as the kick fluids rise in the well bore. For instance, a port in the drill string may be opened at a point above the drill collars which will normally be several hundred feet in length and thus normally extend through the area in which the well kick fluids reside during stabilization of the well.

Alternatively or additionally, provision may be made to inject drilling mud into the well bore at points spaced above the drill collars. Using modern technology control ports may be spaced throughout the drill string and be operated selectively to permit opening of any of the desired ports in the drill string to introduce drilling fluid directly into the well bore at a desired location, which is selected after the well is stabilized. Further, of course, in offshore drilling where the conduits connecting the wellhead at the mud line with the drilling platform have appreciable length, the drilling fluid may be injected at the wellhead, if desired. As the practice of this invention results in advantage when drilling fluid is injected at any point below the choke controlling back pressure on the well bore.

The illustrations of FIGS. 1–3 and 7–10 were obtained through a detailed computer analysis.

Figure 7:
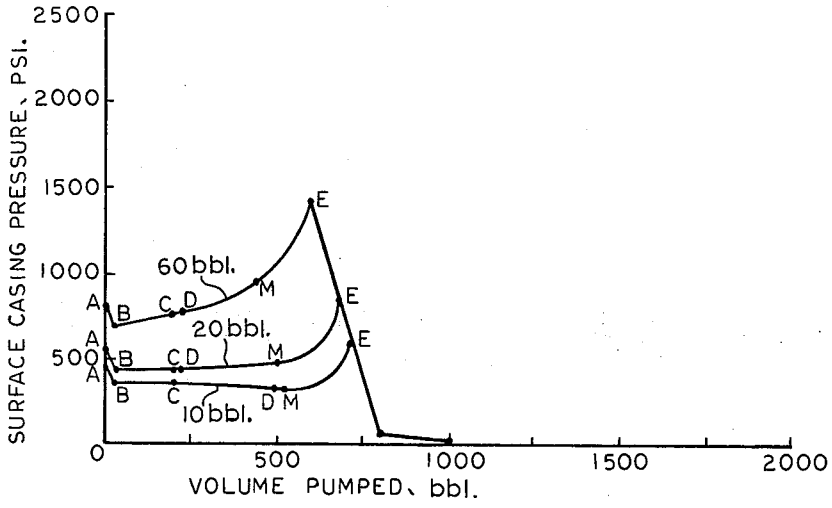
FIG. 7 is a graph illustrating pressure in the top of the well bore for a well kick of different volumes utilizing the wait and weight method.

In FIG. 1 there is shown schematically a conventional situation in which a well is being drilled and a gas kick has occurred. The open well bore is indicated at 20. The upper section of the well bore is cased with surface casing 21. The well has been drilled using the drill string 22 having drill collars with a bit on the lower end thereof indicated at 23. After the gas kick became apparent the blowout preventers indicated schematically at 24 were closed to shut-in the well and permit it to stabilize. As indicated in the drawings the illustrative well which will be used as an example throughout this specification had surface casing 21 set to 3,500 feet and was drilled to a depth of 11,540 feet at the time the gas kick occurred. The drill string included 11,000 feet of 5 inch, 19.5 lb/ft drill pipe and 540 feet of drill collars having an 8 inch external diameter and a 3 inch internal diameter. The formation penetrated in which the kick occurred had a pore pressure of 6300 psig. In stabilized condition the pressure at the upper end of the drill pipe was found to be 300 psig. The shut-in casing pressure would depend upon the size of the kick. As shown in the graph of FIG. 7 with a sixty barrel kick this pressure would be 770 psig with drilling mud of ten pounds per gallon in the well bore and drill pipe.

It is assumed that immediately below the surface casing there is a weak formation having a fracture pressure of 2,700 psig.

In FIGS. 2A and 2B there is illustrated an attempt to remove the kick gas from this problem well where the kick amounted to sixty barrels of gas. The problem envisions the use of the wait and weight method in which 10.5 pound per gallon mud is mixed and is used in the recovery operation. The beginning of pumping the kill mud is illustrated in FIG. 2A and at this time the pressure at the weak formation is 2,580 psig with a back pressure on the casing of 770 psig.

FIG. 2B shows the result after pumping 420 barrels of kill mud into this problem well. The gas bubble has increased in size from an original vertical dimension of about 1,090 feet in the lower end of the well bore to about 1,375 feet. At this time the pressure in the casing at 3,500 feet has increased to 2,700 psig, which is sufficient to fracture the weak formation and result in an underground blowout. It will be noted from FIG. 2 that the gas bubble has expanded to about 100 barrels and to maintain the 6,300+ psig pressure at the bottom of the hole, it is necessary to maintain a back pressure of 860 psig. The large volume occupied by the gas kick, which has a very low density, necessitates the use of the high back pressure on the well bore to maintain the pressure on the formation sufficient to prevent additional formation fluids from entering the well bore.

FIG. 7 shows the casing pressure at the surface for a ten, twenty and sixty barrel gas kick. Point A represents the back pressure after the well has been stabilized. Point B represents the back pressure after the bubble of gas has been moved up the well above the drill collars where there is a greater volume available for the gas to occupy as the annulus above the drill collars is considerably larger than the annulus at the drill collars.

Point C corresponds to the new high density drilling fluid reaching the bottom of the drill string. At Point D the effect of the rapid gas expansion moving up the well bore offsets the beneficial effect of the higher density mud in the well bore and the casing pressure rises from this point on and notwithstanding the fact that additional high density mud is being pumped into the bottom of the well bore. Point M corresponds to the top of the gas reaching this weak formation at 3,500 feet. Point E represents the casing back pressure when the top of the gas zone reaches the surface. From FIG. 7 it is apparent that the problem well could be controlled using the conventional wait and weight method with a small kick, such as ten to twenty barrels of gas, but with a large kick, such as the sixty barrels of gas, use of the wait and weight method would result in an underground blowout.

Figure 8:
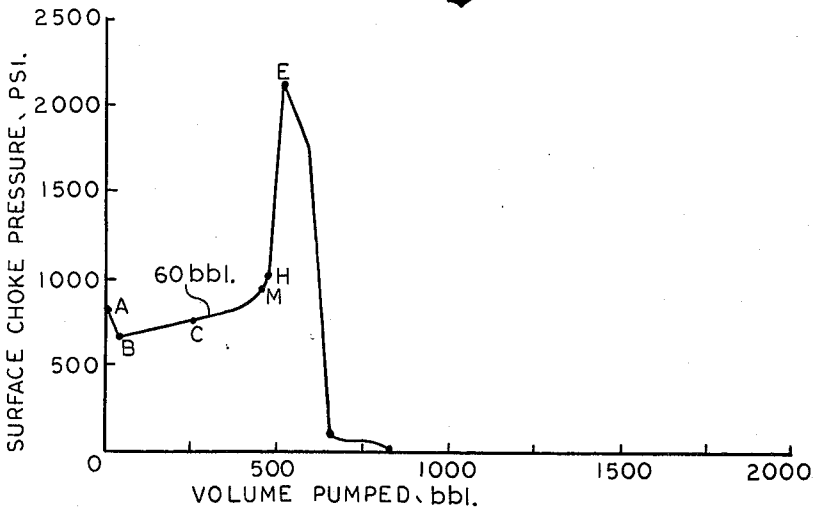
FIG. 8 is a graph similar to FIG. 7 showing pressure at the top of the well bore utilizing a floating drilling vessel.

In FIG. 8 the problem well is represented as being drilled from a floating drilling vessel. The conditions for this example are identical with those discussed above, except that the drilling operations are conducted in 3,000 feet of water and the steel casing extends from the mud line at 3,000 feet to a depth of 6,500 feet for a total casing length of 3,500 feet. The two flow lines extending from the subsea wellhead to the floating drilling vessel have an internal diameter of 3.15 inches. Points A, B, C and M are labeled as in FIG. 7. Point H corresponds to the top of the gaseous zone reaching the sea floor. The choke pressure to maintain the desired pressure at the bottom of the well bore is changing rapidly as shown in FIG. 8. This rapid change in back pressure makes manipulation of the back pressure choke extremely difficult for the choke operator.

Figure 4:
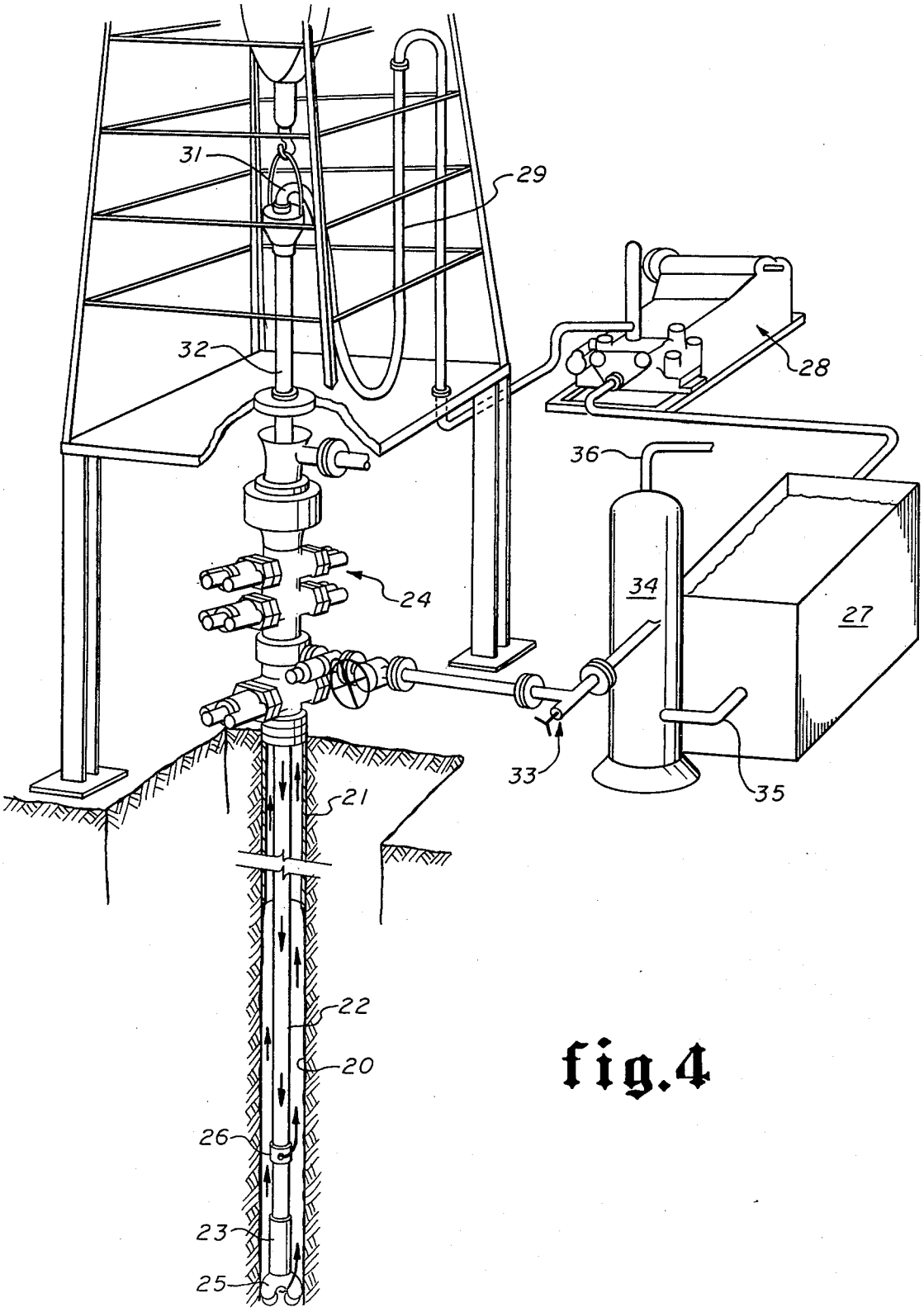
FIG. 4 is a schematic illustration of a well equipped to practice the methods of this invention.

In FIG. 4 there is illustrated a well equipped to practice this invention. The well bore 20 is shown to have a surface casing 21 at its upper end. The drill string 22 includes at its lower end the drill collars 23 with the drill bit 25 on their lower extremity. The wellhead includes the blowout preventers 24 which may include both the ram and annular type.

In accordance with this invention at one or more points along the length of the drill string a flow diverting device indicated generally at 26 is provided in the drill string.

Circulation of mud to remove drilling fluid is carried out with conventional equipment. This equipment includes the mud mixing tank 27 from which mud is withdrawn by the mud pump 28 and introduced through the rotary hose 29 and gooseneck 31 into the kelly 32. The drilling fluid is pumped down the drill string 22 and a portion of the mud continues to the bottom of the drill string while another portion is injected into the well bore through the diverter 26 at a point spaced from the bottom of the well bore. The mud and kick fluids flow upwardly through the well bore and the conventional back pressure choke indicated generally at 33. From the choke the fluids pass through the separator 34 and liquids are returned to the mud tank 27 via line 35. Gases are carried off through line 36.

Reference is now made to FIGS. 3A through 3D, wherein the method of removing a sixty barrel gas kick in the problem well is illustrated.

After stabilization of the well it was determined that in the beginning a back pressure of 770 psig would have to be maintained on the well to maintain a bottom hole pressure slightly in excess of 6,300 psig and prevent entry of further gas into the well bore. A new heavier mud of 10.5 lbs. per gallon was mixed and is beginning to be pumped into the well as shown in FIG. 3A. At this time the entire gas bubble is below the flow diverter 26 and is slowly pumped up the well bore by the kill mud.

A much greater volume of kill mud for this example (four times as much) is being diverted into the well bore at the diverter 26 than is being pumped into the bottom of the well and, as shown in FIG. 3B, the well bore above the diverter is filled with a mixture of predominantly heavy kill mud prior to the top of the bubble reaching the diverter. Even though the gas bubble has increased to a volume of 65 barrels the increase in weight of mud has permitted the back pressure to be reduced to 545 psig.

FIG. 3C shows the conditions in the well as the bottom of the bubble of gas reaches the diverter. The bubble of gas has now been broken into many small bubbles and mixed with mud to provide a mixture averaging about 8 lbs/gal. At this time the back pressure needed to maintain static conditions in the bottom of the hole has risen to 655 psig.

In FIG. 3D conditions are shown when the bottom of the old 10 lb. per gallon mud reaches the diverter. At this time the mud immediately above the diverter is approximately 10.4 lbs. per gallon mud and the back pressure needed to contain the well has dropped to 595 psig after rising to a peak pressure of 1,020 psig when the top of the gas-mud mixture reached the surface.

It should particularly be noted that in FIG. 3A at the start of recovery operations the well pressure at the bottom of the surface casing, which for purposes of the example is considered to be the weakest formation, is subjected to a pressure of 2,580 psig. In FIG. 3B this pressure has dropped to 2,455 lbs. due to the large amount of new kill mud in the well bore. When the gas bubble has reached the weak formation, the formation is subjected to a pressure of only 2,475 psig. From this point, the weak formation is subjected to decreasing pressures. It is thus apparent that during the entire recovery operation the utilization of the instant method maintains the pressure present at the weak formation below the fracture pressure of 2,700 psig and a downhole blowout would not occur. This should be contrasted with using the conventional method in which a downhole blowout would have occurred upon the occasion of a sixty barrel gas kick.

Figure 9:
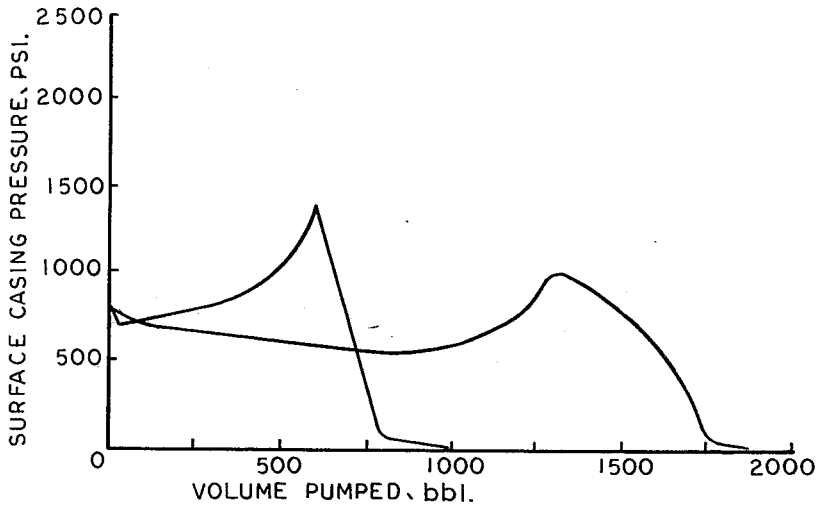
FIG. 9 is a graph comparing the conventional wait and weight method with the bubble chopper method of this invention.

A comparison of the conventional method and the bubble chopper method of this invention illustrated in FIGS. 2A and 2B versus FIGS. 3A through 3D is illustrated in FIG. 9. From this illustration it will be seen that the conventional method results in a surface casing back pressure which is almost 1,500 psig versus the gas dispersion or bubble chopping method in which the maximum pressure reaches approximately 1,000 psig. A much larger volume of mud is pumped when practicing this invention. The volume will, of course, depend upon the position of the diverter 26 and the percentage of mud pumped into the well bore through the diverter as compared to the percentage of mud which is pumped out the bottom of the drill string.

Figure 10:
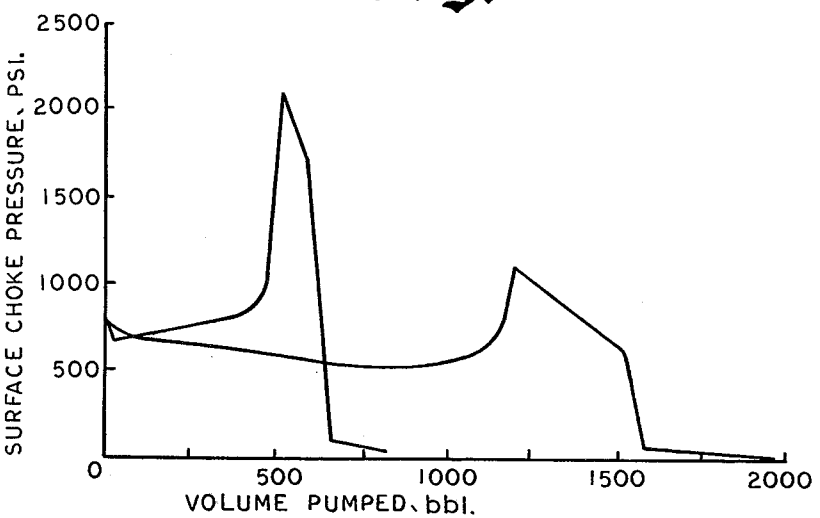
FIG. 10 is a view similar to FIG. 9 comparing the two methods utilizing a floating drilling vessel.

In FIG. 10 a comparison is made of the conventional method versus the bubble chopping or gas dispersion method for the same well being drilled from a floating vessel in the example of FIG. 8. It is apparent from this Figure that an even more dramatic reduction in maximum surface choke pressure results from the practice of this invention.

Figure 5:
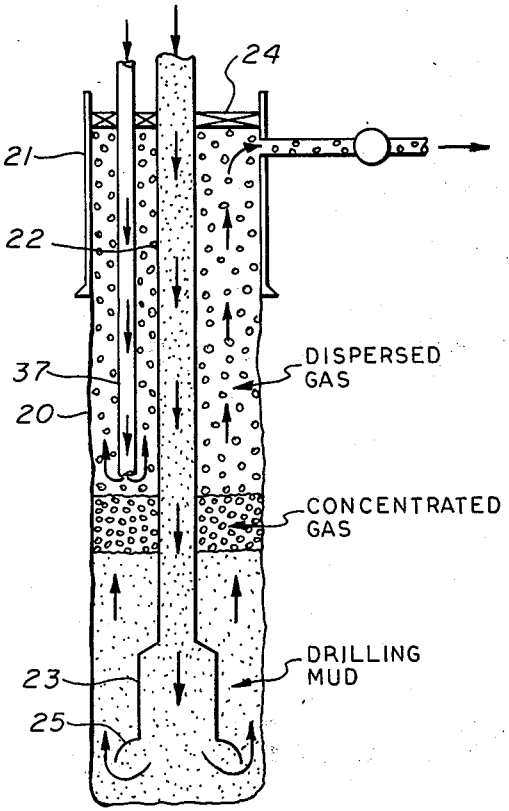
FIG. 5 is a schematic illustration of another form of equipment for practicing the method of this invention.

In FIG. 5 there is shown an alternative method of introducing drilling mud into the well bore at a point above the bottom of the drill string. In this form of the invention a second pipe 37 is run down into the well to the desired level and mud is simultaneously pumped through this auxiliary pipe 37 and the drill string 22.

Figure 6:
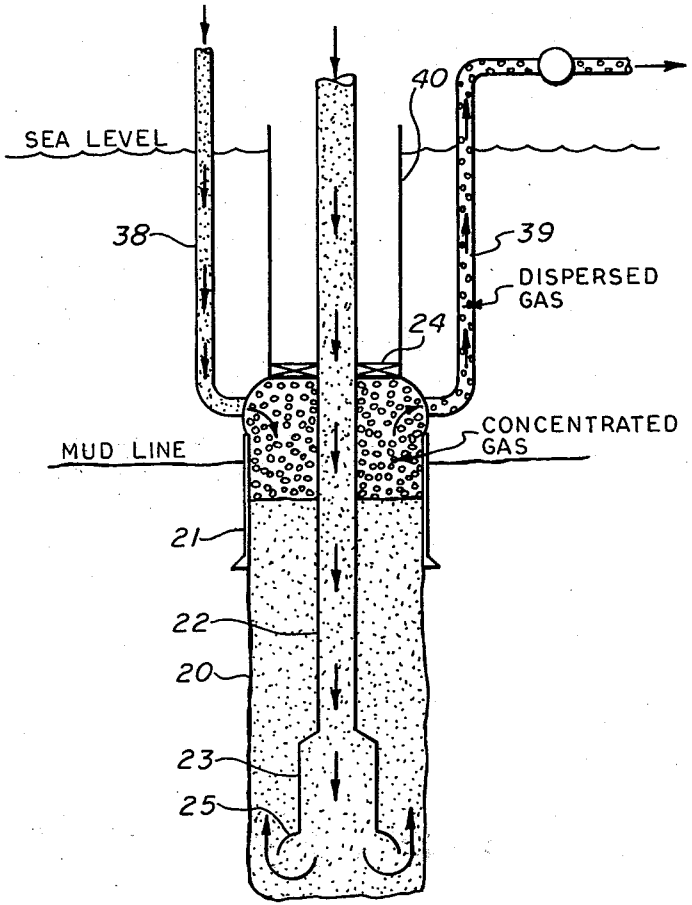
FIG. 6 is a schematic illustration of a still further form of equipment utilized to practice this invention.

In FIG. 6 there is illustrated an alternative method of introducing mud into the flow system above the bottom of the drill string when drilling offshore from a floating vessel. In this instance a riser 40 extends upwardly from the wellhead to the drilling vessel. A subsea flow line 38 introduces mud into the well bore simultaneously with mud being pumped into the drill string. Mud leaves the well bore through the subsea choke line 39 and returns to the surface. This Figure illustrates the control of a well while removing formation fluids therefrom where the wellhead is under a substantial body of water and mixing of drilling mud with the well fluids at the wellhead results in a substantial increase in the weight of the material in the subsea choke line, thus reducing the choke pressure necessary and avoiding the need for extremely rapid changes in choke pressure when substantially pure gas is present in the subsea choke line.

It will be apparent from the above that drilling mud could be introduced at more than one point in the drill string, if desired, and where subsea operations are involved drilling mud could be introduced into the well bore by a flow diverter and be introduced into the wellhead, such as by the subsea flow line 38 as shown in FIG. 6.

Figure 11:
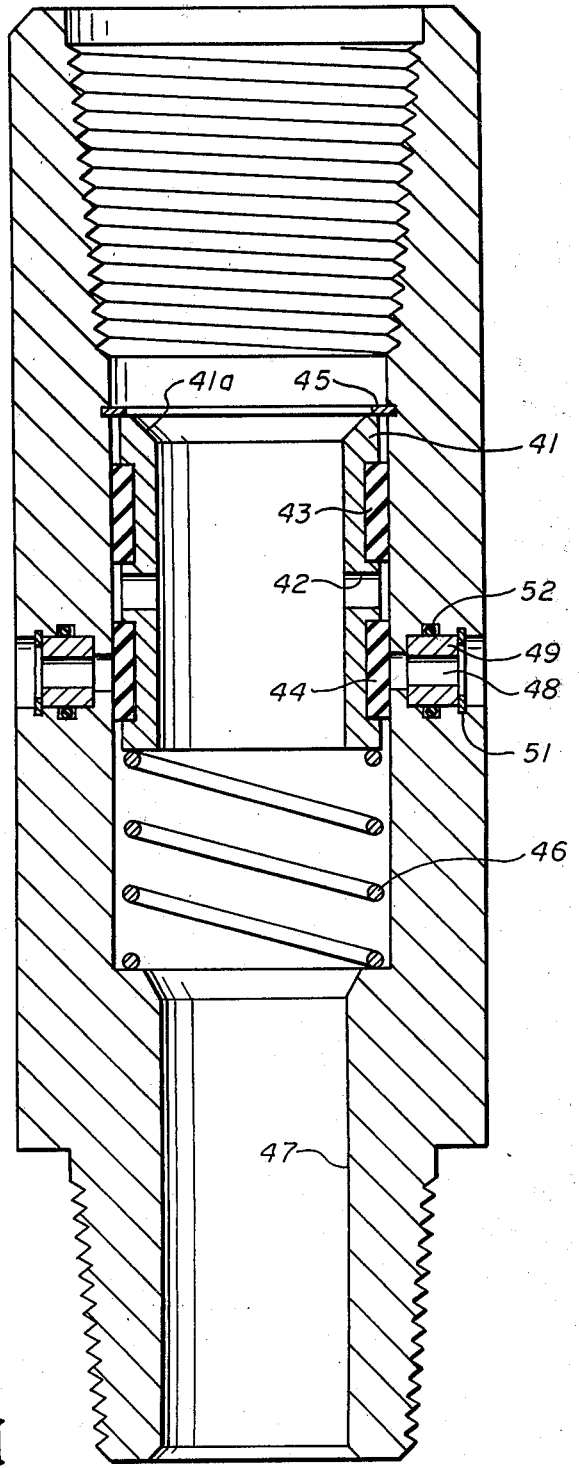
FIG. 11 is a sectional view through a landing nipple to be made up as a part of the drill string in the practice of the method of this invention.

FIG. 11 is a schematic illustration of a landing nipple-diverter which may be installed at any desired point in the drill string. The nipple has standard box and pin joints to allow it to be screwed between two joints of drill pipe. Within the bore of the device is a sliding sleeve 41 equipped with fluid discharge ports 42 and seal elements 43 and 44 to prevent diversion of fluid when the sliding sleeve is in the closed position as shown. The sliding sleeve is held in the closed position against a retainer ring 45 by a compression spring 46. The upper portion of the sliding sleeve 41 is beveled at 41*a* to accept the upper portion of an actuator to be described hereinbelow. The bottom bore 47 of the nipple is polished to accept sealing elements on the lower portion of the actuator. When the sliding sleeve is pushed downwardly by the actuator the fluid discharge port in the sliding sleeve will be aligned with the side ports 48 in the nipple to allow drilling fluid to enter the well bore. The changeable side port orifice 49 is preferably made of an erosion resistant material. It is held in place by a retainer ring 51 and an O-ring seal 52 prevents fluid leakage around the orifice.

Figure 12:
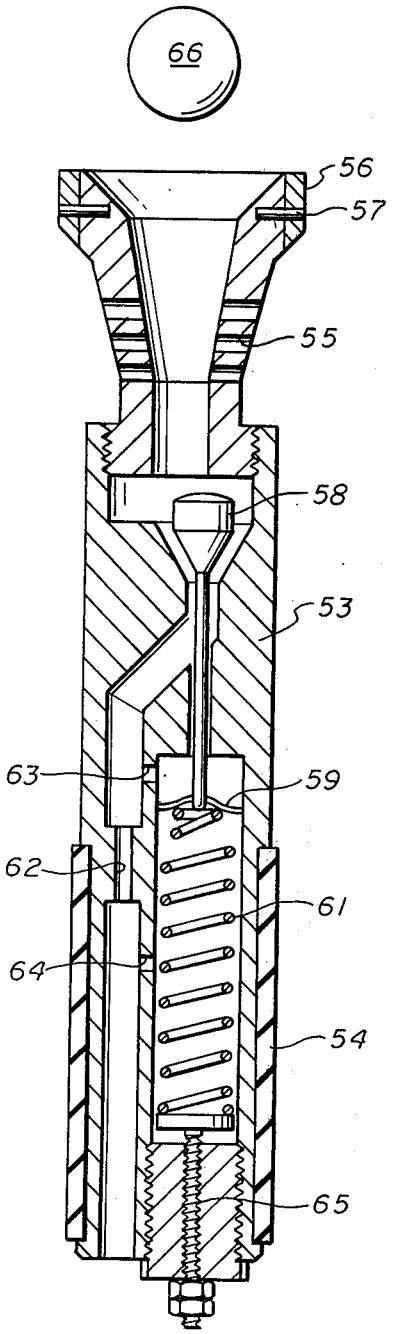
FIG. 12 is a view in section of an actuator and diverter for landing in the landing nipple of FIG. 11.

FIG. 12 is a schematic illustration of an actuator which provides a portion of the diverter. The actuator would be dropped from the surface after a well kick is experienced. The actuator has a body 53 with seal elements 54 surrounding its bottom portion to seal against the polished bore 47 of the landing nipple to prevent downward fluid passage around the actuator. Thus, all downward fluid flow would be forced to pass through the actuator. The upper portion of the actuator is provided with a plurality of ports 55 to provide easy passage of mud through the side port 49 of the landing nipple. At the upper end of the actuator a catching sleeve 56 is pinned to the actuator body 53 by one or more shear pins 57. The lower extremity of the sleeve 56 is beveled to mate with and land upon the upper beveled surface 41*a* of sleeve 41 of the landing nipple.

Downward flow through the device is maintained at a constant arrangement by the pressure regulator throttle 58, the diaphragm 59, the compression spring 61, the orifice 62, the upstream pressure ports 63 and the downstream pressure port 64. An adjustment screw 65 is provided to vary the compression of the spring and set the downward flow rate at the desired value.

The diaphragm is at equilibrium when the pressure at the upstream port 63 exceeds the pressure at the downstream port 64 by an amount equal to the compressional force in the spring divided by the area of the diaphragm. The throttle 58 will cause adjustment of the pressure at the upstream port 63 for this equilibrium condition to exist. Thus, a constant pressure differential exists across the orifice 62 causing a constant flow rate through the orifice.

It is desirable to prevent flow from the annulus into the drill pipe if circulation is stopped. This can be accomplished simply by making the spring 46 in the nipple strong enough to push the sliding sleeve 41 upward to the closed position when circulation is stopped and the downward pressure differential across the actuator is eliminated. It would also be desirable to be able to deactivate the device without pulling the drill string from the hole so that drilling operations could be rapidly resumed after completion of the well control operations. This could be accomplished by dropping a ball 66 which would form a seal in the top portion of the actuator. Pump pressure applied to the completely closed system would cause the shear pins 57 to fail allowing the actuator assembly to be pumped through the body of the landing nipple-diverter. In most cases the bore of the drill collars would be large enough to permit the actuator to fall to the bottom of the drill string and be caught above the bit. If this is not true, a suitable sub could be used below the new device which will retain the actuator and allow unrestricted flow around the actuator. Once the actuator is pumped from the landing nipple, the nipple sleeve will close and all flow will continue downwardly through the drill string.

If desired, the landing nipple and actuator-diverter could be provided with selector key grooves and selector keys in the conventional manner so that several landing nipples could be spaced along the drill string and selector keys utilized to land the actuator in the desired landing nipple. Also, different sized landing surfaces 41*a* and sleeves 56 could be utilized to selectively land the diverter at various nipples in the drill string.

Figure 13:
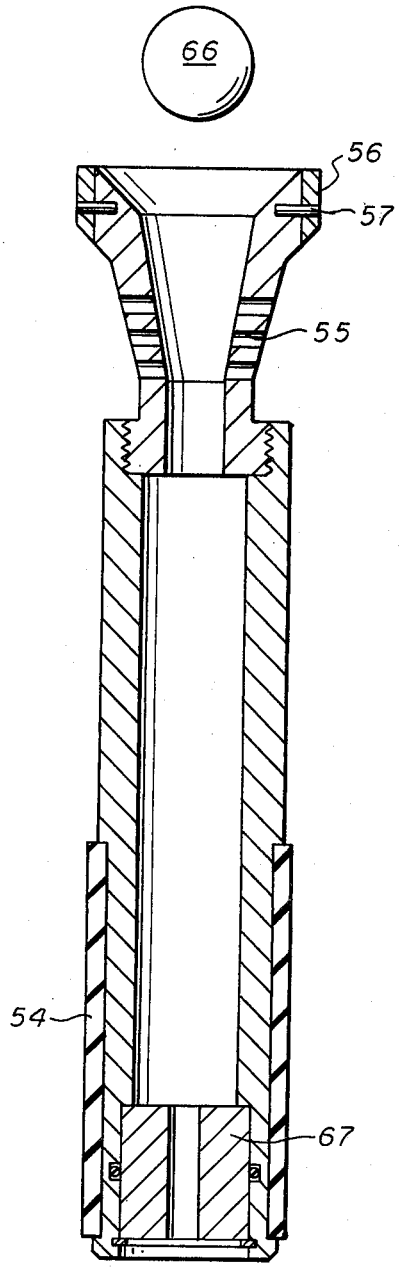
FIG. 13 is a view in section of another form of actuator and diverter for landing in the landing nipple of FIG. 11.

FIG. 13 shows another form of diverter in which an orifice or flow bean 67 is substituted for the regulator. This apparatus has a disadvantage of not maintaining the flow rate down the drill string constant as the gaseous zone moves up and the annular pressure outside the side port changes. Using past procedures this would make choke operation more difficult because bottom hole pressure changes could not be conveniently related to changes in the surface drill pipe pressure. However, methods for directly monitoring the bottom hole pressure are being introduced at present and when this capacity becomes routinely available, choke operations will be based on direct observation of bottom hole pressure and the simple type actuator of FIG. 13 will be more attractive. Also, the bean 67 could be a solid plug forcing all flow through the side ports. As the lighter gas slowly rises past the device under the influence of gravity it would be dispersed in the drilling fluid. This procedure will be useful after direct monitoring of bottom hole pressure becomes routinely available.

The foregoing disclosure and description of the invention are illustrative and explanatory thereof and various changes in the size, shape and materials, as well as in the details of the illustrated construction, may be made within the scope of the appended claims without departing from the spirit of the invention.

What is claimed is:

1. Flow control apparatus comprising,
a body,
seal means on the exterior of the body,
a diaphram mounted in said body,
a bore through the body including a reduced diameter orifice,
upstream and downstream ports on opposite sides of said orifice communicating the bore with opposite sides of said diaphram,
resilient means urging said diaphram toward its upstream pressure side,
a pressure regulator throttle in said bore controlling pressure in said upstream port in response to changes in pressure differential across said diaphram, and
a detachable catching sleeve secured to said body by a frangible member and adapted to support the apparatus in a landing nipple.

2. The apparatus of claim 1 including a seat in the bore adjacent its upstream end adapted to receive a plug.

3. The apparatus of claim 1 or 2 including lateral ports in the body communicating the bore above the throttle valve with the exterior of the body between the catching sleeve and seal means.

4. In combination:
a landing nipple-diverter comprising,
a body,
a bore through the body,
a port in the side wall of the body communicating the bore with the exterior of the body,
a valve member slidable in the bore controlling flow through said port,
resilient means urging said slide valve upwardly toward port closing position; and
a shoulder on said valve member for supporting a flow control device,
said bore having a section adapted to sealingly receive a flow control device; and flow control apparatus comprising,
a body,
seal means on the exterior of the body sealing with said bore section,
a diaphram mounted in said body,
a bore through the body including a reduced diameter orifice,
upstream and downstream ports on opposite sides of said orifice communicating the bore with opposite sides of said diaphram,
resilient means uriging said diaphram toward its upstream pressure side,
a pressure regulator-throttle in said bore controlling pressure in said upstream port in response to changes in pressure differential across said diaphram, and
a detachable catching sleeve secured to said body by a frangible member and supporting the flow control apparatus on said valve member shoulder.

5. The combination of claim 4 wherein
the landing nipple-diverter valve member has a port in its side wall and seal means are provided on opposite sides of said port, and
wherein the flow control apparatus body has lateral ports in the body communicating the bore above the throttle valve and below said catching sleeve with the landing nipple-diverter valve member port.

6. The combination of claim 4 or 5 wherein a seat is provided in the flow control apparatus bore adjacent its upstream end adapted to receive a plug.

* * * * *